United States Patent [19]

Chin et al.

[11] Patent Number: 4,785,642

[45] Date of Patent: Nov. 22, 1988

[54] DECORATIVE CLIP WITH PERFUME DISPENSER

[75] Inventors: Yu-Mei Chin, Taoyuan Hsien; Ming-Chi Huang, Taipei, both of Taiwan

[73] Assignee: Eric Chiao Shih, Pasadena, Calif.

[21] Appl. No.: 2,879

[22] Filed: Jan. 13, 1987

[51] Int. Cl.[4] ..... A44C 7/00

[52] U.S. Cl. ..... 63/1.1; 63/2; 63/14.1; 63/14.4; 63/DIG. 2

[58] Field of Search ..... 63/1 R, DIG. 2, 2, 14 R, 63/14 C, 14 D

[56] References Cited

U.S. PATENT DOCUMENTS

| | | | |
|---|---|---|---|
| 130,421 | 8/1872 | Frederick | 63/1 R |
| 2,265,670 | 12/1941 | Platt | 63/20 X |
| 2,276,592 | 3/1942 | Reitman | 63/20 X |
| 2,560,681 | 7/1951 | Berkowitz | 63/DIG. 2 X |
| 2,616,215 | 11/1952 | Martial et al. | 63/20 X |
| 2,798,148 | 7/1957 | di Lizio et al. | 63/1 |
| 3,384,740 | 5/1968 | Wood | 63/14 R X |
| 4,009,381 | 2/1977 | Schreiber et al. | 63/2 X |

FOREIGN PATENT DOCUMENTS

| | | | |
|---|---|---|---|
| 2112649 | 9/1972 | Fed. Rep. of Germany | 63/1 R |
| 596282 | 10/1925 | France | 63/DIG. 2 |
| 1226366 | 7/1960 | France | 63/DIG. 2 |
| 2565724 | 12/1985 | France | 63/20 |
| 593649 | 12/1977 | Switzerland | 63/20 |
| 4709 | of 1885 | United Kingdom | 63/DIG. 2 |
| 936349 | 9/1963 | United Kingdom | 63/1 R |

*Primary Examiner*—Kenneth J. Dorner
*Assistant Examiner*—Laurie K. Cranmer
*Attorney, Agent, or Firm*—Cushman, Darby & Cushman

[57] ABSTRACT

A decorative clip for use as a jewelry item is disclosed which shines and glitters in the dark and emits perfume. This shining and glittering effect is achieved by placing an LED or an LCD device powered by a small battery beneath a decorative housing. When the clip is worn, the circuit between the battery and the LED or LCD is completed such that current may flow. In addition, a perfume dispenser is provided integral to the clip such that a fragrance is continuously emitted without interacting with the body chemistry of the wearer of the clip. The perfume dispenser is detachable so that the perfume may be changed or refilled as the wearer desires.

19 Claims, 2 Drawing Sheets

DECORATIVE CLIP WITH PERFUME DISPENSER

BACKGROUND OF THE INVENTION

1. Field of the Invention

The present invention relates to a jewelry article which may be used as an earring, a hair clip, a lapel pin, and the like. More particularly, the present invention relates to a decorative clip which shines in the dark and emit perfume.

2. Description of the Prior Art

Men and women have traditionally used jewelry and other decorative items as means for beautifying themselves. Such jewelry comes in many shapes and sizes and is made up of any of a number of materials such as gold, silver, plastic, and the like. Such materials are often selected for their shiny, reflective surfaces which bedazzle the admirer. Each of these materials has its own special quality which makes it particularly attractive for use in certain types of jewelry; however, these materials often have major drawbacks for their use, such as excessive cost. Consequently, it is desirable to design a new type of decorative jewelry which can shine and glitter just as the more expensive materials do yet without the excessive cost of those materials.

Other ways in which men and women improve their attractiveness is by applying perfume or cologne. Perfumes and colognes come in a variety of odors which are selected by each individual according to his or her particular preferences. The resulting sweet smell is often short lived, however. The fragrance of a perfume or a cologne quickly evaporates with the passage of time or is washed away when the user takes a bath. Some perfumes and colognes do not provide the fragrances desired because the body constitution of the user chemically reacts with the perfume or cologne and changes its original smell such that the fragrance is no longer desirable. In addition, some individuals cannot wear particular fragrances because they are sensitive to its contents. As a result, some fragrances cannot be worn at all by those individuals.

SUMMARY OF THE INVENTION

The present invention is directed to a novel jewelry item which provides the shiny, glittering effect of expensive jewelry yet is inexpensive in design. In addition, a perfume dispenser is provided integral to the clip of the jewelry article such that a fragrance can be expelled without reacting with the skin of the wearer of the jewelry. Such a jewelry item can be designed to take any of a variety of shapes and sizes and can be worn on several different parts of the body. The decorative clip of the present invention, therefore, may be used as an earring, a hair clip, or a pin.

The decorative clip in accordance with the present invention performs two different functions. First of all, an LED or an LCD is integrally disposed within the clip such that it is activated when the clip is worn. This is accomplished by providing a battery which sends current to the LED or LCD when pressure is applied against the back of the clip, such as when the clip is worn.

The second function on of the present invention is to integrally contain a perfume dispenser for continually dispensing a fragrance through a small opening. In this manner, a fragrance can be continuously expelled without the possibility of an allergic or chemical reaction with the wearer.

Figure 1:
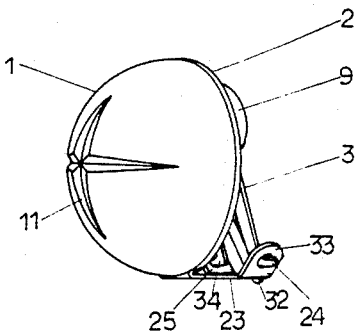
FIG. 1 is a perspective view of an exemplary embodiment of the present invention.

FIG. a view of the embodiment shown in FIG. 1

Figure 4:
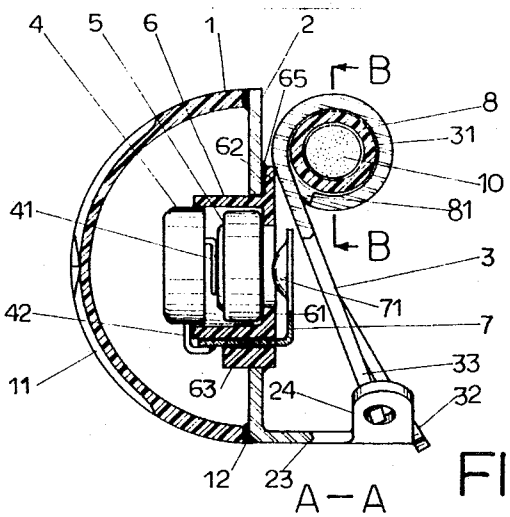
Figure 3:
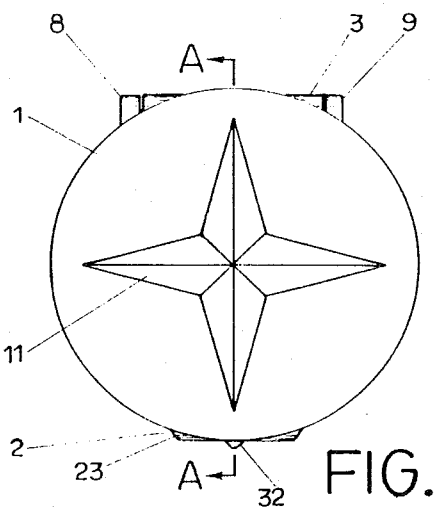

FIG.is a cross-sectional view along line A—A of the e shown in FIG. 3;

FIG. a cross-sectional view along line B—B of the embodiment shown in FIG. 4; and FIG. a schematical drawing of the electrical circuit used in the present invention.

DESCRIPTION OF THE PREFERRED EMBODIMENT

FIG. 1 shows a perspective view of an earring embodying the present invention. The main body of the earring includes a decorative housing 1 which is made of transparent plastic. It is shown to be a semi-globular shell containing patterns 11 which increase the beauty of the earring and reflect the light emanating from the earring. Although the decorative housing 1 is shown to be semi-globular, the shape of the housing is a matter of choice and can be of any of a variety of shapes or colors. The earring is held on the wearer's ear by an assembly including clamp sheet 3, fixed sheet 2, and the clamp sheet receptacles 24 and 25. The structure of the present invention will be discussed in more detail with reference to FIG. 2.

Figure 2:
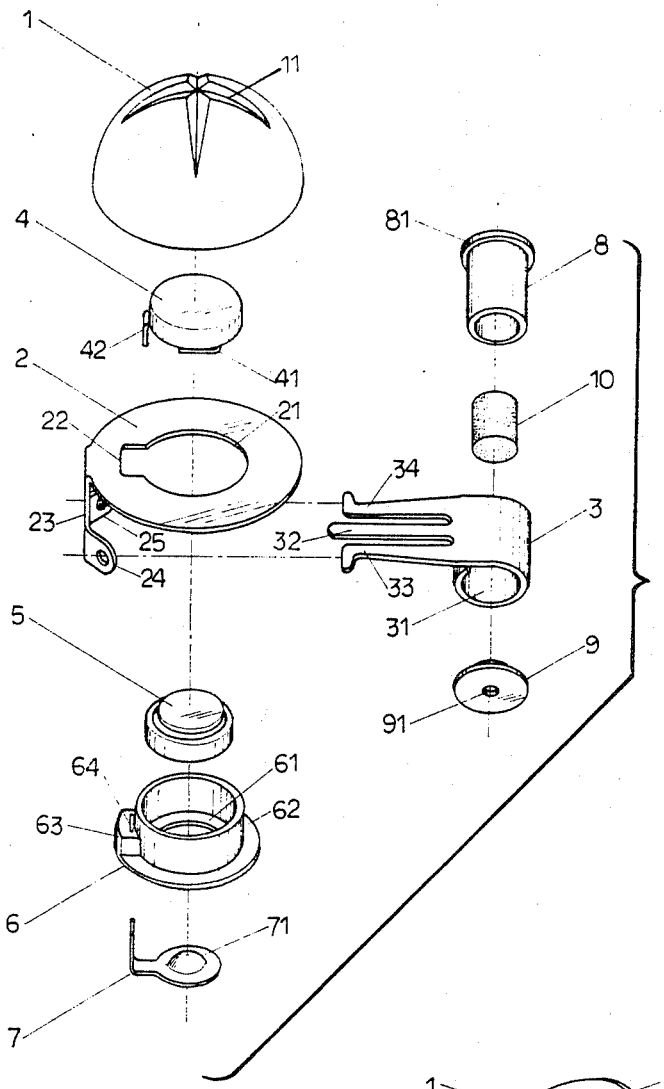
FIG. 2 is an exploded view of the embodiment shown 1.

FIG. 2 shows the interrelationship of the main body parts of the decorative clip. Decorative housing 1 containing patterns 11 is connected to a fixed sheet 2 which is shaped so as to coordinate with the shape of the decorative housing. In FIG. 2, for example, the fixed sheet is represented as a planar metal sheet of circular shape with a hole 21 in the center. On one side of the hole 21 is a notch 22, and on the outer circumference of that side of the circular sheet the metal sheet is bent to form an extension sheet 23. At the end of the extension sheet 23 are clamp sheet receptacles 24 and 25 which bend outward. The clamp sheet 3 connects to the extension sheet 23 by means of receptacles 24 and 25. This clamp sheet 3 may be made of metal and is rolled such that a cylindrical cavity 31 is formed. The other end of the clamp sheet 3 contains three prongs. The middle prong comprises a long and strait spring sheet 32 which functions as a spring for clamping the clip to the parts of the body or clothing. The outer prongs 33 and 34 connect to the receptacles 24 and 25, respectively. Prongs 33 and 34 are curved into an L-shape and are symmetrical to each other such that they fit into the holes of receptacles 24 and 25.

The shining and glittering effect of the present invention is achieved by use of a light emitting diode (LED) disposed behind the decorative housing 1. The LED 4 may be of any of a variety of shapes, depending upon the particular jewelry article being designed. In the embodiment shown in FIG. 2, for example, the LED 4 is of a flat, circular shape. The size of the LED is, of course, limited by the size of the decorative housing 1; however, the LED may be selected such that the entire fixed sheet 2 is covered by it. LED 4 emits glittering light so that the decorative housing appears to shine and glitter in the dark. In the daylight, however, the brightness of the LED may not be satisfactory; therefore, the LED 4 may be replaced by a liquid crystal display (LCD) which emits glittering patterns that are more visible in the daylight.

LED 4 is connected by leads 41 and 42 to a small button-type cell 5. Cell 5 may be a nickel cadmium cell or a mercuric oxide cell which is of sufficiently small size. Cell 5 is supported by a cell housing 6 which is made of a suitable nonconductive material. At one end of a cylindrical portion of cell housing 6 are ring-shaped protruding edges 61 and 62 on the inside and outside of the housing, respectively. Cell 5 is rested on the inside protruding edge 61, and on the outside protruding edge 62, a protruding block 63 is placed. Protruding block 63 is disposed such that it is in alignment with notch 22 on the fixed sheet 2, thereby enabling the protruding block to pass through the notch 22 when assembled. In addition, there is a rectangular hole 64 in protruding block 63 which is parallel to the direction of the axis of the cell housing 6. Hole 64 accepts one end of a spring sheet 7. Spring sheet 7 is made of an L-shaped conductive material, and one end of the conductive spring sheet 7 contains an indented convex portion 71 which contacts the body portion of cell 5 when the clip is worn, as will be discussed below with reference to FIG. 4.

Also shown in FIG. 2 is a perfume dispenser comprised of a cylinder 8 with a protruding edge 81 at its closed end, a cylinder cap 9 with a dispensing hole 91, and a perfume holding body 10. Cylinder 8 may be made of plastic, and cylinder cap 9 is made of a flexible material such as rubber. Perfume holding body 10 is made of an absorbent material such as a sponge, cotton, and the like. This perfume holding material 10 is fitted inside the cylinder 8. The perfume storage assembly made up of elements 8, 9 and 10 is then fitted into cavity 31 of clamp sheet 3. Protruding edge 81 keeps the storage assembly from sliding out of one end of the cavity 31, while the cylinder cap 9 contains a protruding edge which keeps the storage assembly from sliding out the outer end of cavity 31.

FIG. 3 is a front view of a clip earring in accordance with the present invention. This view more clearly shows a possible design for the patterns 11.

FIG. 4 is a cross-sectional view along the cutting line A—A of FIG. 3. Decorative housing 1 is adhered to the fixed sheet 2 by a strong adhesive 12. The receptacle 24 of the fixed sheet 2 has a round hole which is provided for the passing through of the L-shaped portion of prong 33 of clamping sheet 3. L-shaped prong 34 fits into receptacle 25 (not shown) in a similar manner. Thus the clamping sheet 3 may rotate by means of an axis composed of the L-shaped portions of prongs 33 and 34 and the receptacles 24 and 25. Spring sheet 32 extends beyond extension 23 such that a recoil force, caused by the bending strength of the metal of which prong 32 is made, is exerted when the rolled end of clamping sheet 3 is pulled away from the fixed sheet 2. In this manner, a clamping force is applied when an ear or an article of clothing is placed between fixed sheet 2 and clamping sheet 3.

Figure 6:
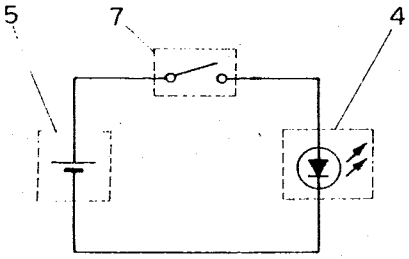

The structural disposition of the LED 4 and cell 5 can be seen more clearly with further reference to FIG. 4. Cell 5 is placed in the cell housing 6 and is constrained by the protruding edge 61 on the inside of the housing. The other side of the cell 5 contacts LED 4 via terminal lead 41 which is connected to the negative pole of cell 5. The rectangular end (non-convex end) of conductive spring sheet 7 passes through the rectangular hole 64 of the protruding block 63 of cell seat 6 and then is welded or otherwise affixed to the other terminal lead 42 of LED 4. As shown, the convex portion 71 of spring sheet 7 is kept at a distance from the positive pole of cell 5 so that the circuit is not completed when the clip is not being worn. In other words, the LED 4 does not emit light when the convex portion 71 does not touch the positive pole of battery 5. When the clip is being worn, however, the LED 4 emits light because the circuit is completed when the fixed sheet 2 and the clamping sheet 3 clamp the earring, thereby naturally squeezing the spring sheet 7 so that convex ring 71 connects with the positive pole of cell 5. The resulting circuit and the corresponding components are shown schematically in FIG. 6.

During assembly, the cylindrical body of the cell housing 6 passes through the round hole of fixed sheet 2, and the protruding block 63 fits into the notch 22 at the side of the round hole 21 such that the housing can be fixed in its proper position. A strong adhesive compound 65 is then applied on the outer protruding edge 62 of the cell housing 6 so that the assembly is affixed to the fixed sheet 2. The cell housing 6 can also be connected to the fixed sheet 2 in a nonpermanent manner such that battery 5 or LED 4 may be replaced, thereby extending the time that the glittering effect may be experienced.

Figure 5:
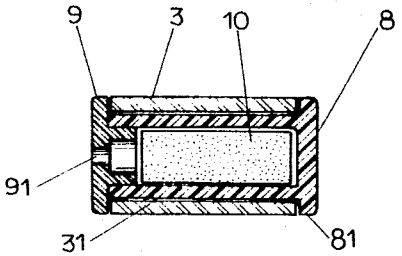

The perfume dispenser of the present invention can be seen in more detail with reference to FIG. 5, which shows a cross-sectional view of the perfume dispenser along lines B—B of FIG. 4. Perfume holding body 10 is filled with perfume and placed in the cylinder 8. The cylinder 8 is then placed in the cavity 31 of the clamping sheet 3 such that the protruding edge portion 81 comes into contact with the edge of clamping sheet 3. Cap 9 is then inserted into the open end of the cylinder 8. The cap 9 is inserted until the circumference of the cap fits snugly against the cylinder 8 and the clamping sheet 3. In this manner the protruding edge 81 of the cylinder 8 and the edge of cylinder cap 9 respectively hold the perfume dispenser so that it will not fall out of the clamping sheet 3. The perfume dispenser of the present invention thus enables the user to replace the perfume or increase the quantities stored in the dispenser.

Dispensing hole 91 on the cylinder cap 9 allows a fixed amount of fragrance to be released on a continual basis. In this manner, the wearer of the clip gets to enjoy the fragrance of the perfume without having to place any perfume on his or her body, thereby avoiding the bodily reactions with the perfume which may occur when the perfume is worn directly on the body. When the clip is not in use, it may be stored within a sealed jewelry box to avoid the natural emission of fragrance. In addition, the fragrance may be preserved more effectively by plugging the dispensing hole 91 when the clip is not in use.

What is claimed is:

1. A decorative clip for use as an article of jewelry, comprising:

a decorative housing;

a light emitting device, with first and second terminals, disposed behind said decorative housing;

a fixed sheet in contact with the back of said decorative housing, said fixed sheet containing a planar portion with a central opening;

a cell with first and second terminals;

a cell housing holding said cell and fitting through said central opening of said fixed sheet such that said first terminal of said cell contacts said terminal of said light emitting device;

a conductive spring sheet with first and second end portions, said first end portion of said conductive spring sheet connected to said second terminal of said light emitting device, said second end portion of said conductive spring sheet displaced by a small distance from said second terminal of said cell, wherein current flows through said light emitting device when said second end portion of said conductive spring sheet is brought into contact with said second terminal of said cell;

a clamping sheet with first and second end portions, said first end portion of said clamping sheet being connected to said fixed sheet such that said clamping sheet rotates in a plane substantially perpendicular to said planar portion of said fixed sheet, and said second end portion of said clamping sheet forming a cylindrical cavity; and a fragrance dispenser disposed within said cylindrical cavity.

2. A decorative clip in accordance with claim 1, wherein said decorative housing is semi-globular.

3. A decorative clip in accordance with claim 2, wherein said planar portion of said fixed sheet and said central opening are circular in shape.

4. A decorative clip in accordance with claim 1, wherein said decorative housing contains patterns which reflect the light emitted by said light emitting device.

5. A decorative clip in accordance with claim 1, wherein said decorative housing is made of transparent plastic.

6. A decorative clip in accordance with claim 1, wherein said light emitting device is a light emitting diode.

7. A decorative clip in accordance with claim 1, wherein said light emitting device is a liquid crystal display.

8. A decorative clip in accordance with claim 1, wherein said fixed sheet is comprised of metal and substantially corresponds to the shape of the back of said decorative housing.

9. A decorative clip in accordance with claim 1, wherein said fixed sheet further comprises an extension sheet substantially perpendicular to said planar portion, said extension sheet forming symmetrically disposed protruding sheets, wherein each of said protruding sheets contains a small hole for accepting said first end portion of said clamping sheet.

10. A decorative clip in accordance with claim 1, wherein one side of said central opening has a notch through which said cell housing passes such that said cell housing cannot rotate with respect to said fixed sheet.

11. A decorative clip in accordance with claim 1, wherein said cell is a button-type nickel cadmium cell.

12. A decorative clip in accordance with claim 1, wherein said cell is button-type mercuric oxide cell.

13. A decorative clip in accordance with claim 1, w said cell housing comprises a cylindrical member with an inner and an outer protruding edge at one end, said inner protruding edge supporting said cell and said outer protruding edge preventing said cell housing from passing completely through said central opening.

14. A decorative clip in accordance with claim 13, wherein said outer protruding edge further includes a protruding block which passes through. said central opening, said protruding block containing a rectangular hole parallel to the axis of said cylindrical member through which said first end portion of said conductive spring sheet passes for connection to said second terminal of said light emitting device.

15. A decorative clip in accordance with claim 1, wherein said second end portion of said conductive spring sheet contains a convex portion, said convex portion contacting said second terminal of said cell when said decorative clip is being used.

16. A decorative clip in accordance with claim 2, wherein said clamping sheet is made of metal and said first end portion contains a straight spring sheet which applies a recoiling force to said clamping sheet when said clamping sheet is moved away from said fixed sheet.

17. A decorative clip in accordance with claim 2, wherein said fragrance dispenser comprises:

a cylinder which fits into said cylindrical cavity;

a cylinder cap made of a flexible material, said cylinder cap containing a small hole; and an absorbing means, said absorbing means filled with a fragrance and placed inside said cylinder and covered by said cylinder cap such that said fragrance escapes through said small hole in said cylinder cap.

18. A decorative clip for use as an article of jewelry, comprising:

a decorative housing;

a light emitting device, with first and second terminals, disposed behind said decorative housing;

a fixed sheet in contact with the back of said decorative housing containing a planar portion with a central opening;

a cell with first and second terminals;

a cell housing holding said cell and fitting through said central opening of said fixed sheet such that said first terminal of said cell contacts said first terminal of said light emitting device;

a conductive spring sheet with first and second end portions, said first end portion of said conductive spring sheet connected to said second terminal of said light emitting device, said second end portion of said conductive spring sheet displaced by a small distance from said second terminal of said cell, wherein current flows through said light emitting device when said second end portion of said conductive spring sheet is brought into contact with said second terminal of said cell;

a clamping sheet with first and second end portions, said first end portion of said clamping sheet connected to said fixed sheet such that said clamping sheet rotates in a plane substantially perpendicular to said planar portion of said fixed sheet, wherein said second end portion of said clamping sheet forms a cylindrical cavity; and a fragrance dispenser disposed within said cylindrical cavity, comprising a cylinder which fits into said cylindrical cavity; a cylinder cap made of a flexible material, said cylinder cap containing a small hole; and an absorbing means, said absorbing means filled with a fragrance and placed inside said cylinder and covered by said cylinder cap such that said fragrance escapes through said small hole in said cylinder cap.

19. A decorative clip for use as an article of jewelry, comprising:

a decorative housing;

a light emitting device, with first and second terminals, disposed behind said decorative housing;

a fixed sheet substantially corresponding to the shape of and in contact with the back of said decorative housing, said fixed sheet containing a planar portion with a central opening including a notch in one side and an extension sheet substantially perpendicular to said planar portion, said extension sheet forming symmetrically disposed protruding sheets, wherein each of said protruding sheets contains a small hole;

a cell with first and second terminals;

a cell housing holding said cell and fitting through said central opening of said fixed sheet such that said first terminal of said cell contacts said first terminal of said light emitting device, wherein said cell housing comprises a cylindrical member with an inner and an outer protruding edge at one end, said inner protruding edge supporting said cell and said outer protruding edge preventing said cell housing from passing completely through said central opening; and a protruding block on said outer protruding edge, said protruding block containing a rectangular hole parallel to the axis of said cylindrical member, wherein said protruding block fits into said notch in said central opening to fix the position of the cell housing such that said cell housing cannot rotate in the plane of said fixed sheet;

an L-shaped conductive spring sheet with first and second en portions, said first end portion of said conductive spring sheet passing through said rectangular hole in said protruding block and connecting to said second terminal of said light emitting device, said second end portion of said conductive spring sheet containing a convex portion displaced by a small distance from said second terminal of said cell, wherein current flows through said light emitting device when said convex portion is brought into contact with said second terminal of said cell, said contact occurring when said decorative clip is being used;

a clamping sheet with first and second end portions, said first end portion of said clamping sheet comprising symmetrically disposed L-shaped prongs which fit into said small holes in said protruding sheets such that said clamping means rotates in a plane substantially perpendicular to said planar portion of said fixed sheet, said first end of said clamping sheet further comprising a straight spring sheet which applies a recoiling force to said clamping sheet when said clamping sheet is moved away from said fixed sheet, wherein said second end portion of said clamping sheet forms a cylindrical cavity; and a fragrance dispenser disposed within said cylindrical cavity comprising a cylinder which fits into said cylindrical cavity; a cylinder cap made of a flexible material, said cylinder cap containing a small hole; and an absorbing means, said absorbing means filled with a fragrance and placed inside said cylinder and covered by said cylinder cap such that said fragrance escapes through said small hole in said cylinder cap.

* * * * *